United States Patent [19]

Cooperstein

[11] 3,982,084

[45] Sept. 21, 1976

[54] SHOCKPROOF ELECTRICAL WALL RECEPTACLE

[75] Inventor: Norman Cooperstein, Long Beach, N.Y.

[73] Assignee: The Raymond Lee Organization, Inc., New York, N.Y. ; a part interest

[22] Filed: Oct. 23, 1975

[21] Appl. No.: 625,256

[52] U.S. Cl. ..... 200/51.09

[51] Int. Cl.[2] ..... H01V 33/30

[58] Field of Search ..... 200/51.07–51.09; 339/40, 42

[56] References Cited

UNITED STATES PATENTS

| | | | |
|---|---|---|---|
| 2,735,906 | 2/1956 | Avrunin | 200/51.09 |
| 3,596,019 | 7/1971 | Koester | 200/51.09 |
| 3,699,285 | 10/1972 | Leatherman | 200/51.09 |

FOREIGN PATENTS OR APPLICATIONS

| | | | |
|---|---|---|---|
| 580,397 | 8/1958 | Italy | 200/51.09 |

*Primary Examiner*—Harry Moose
*Attorney, Agent, or Firm*—Daniel Jay Tick

[57] ABSTRACT

A shockproof electrical wall receptacle comprises resilient ends of electrically conductive material extending from ends of two electrically conductive circuit members in the box in spaced angular relation with each other in a generally V shape and positioned between the prongs of an electrical connector plug inserted in the box and spaced therefrom. A housing of rectangular parallelepiped configuration is movably mounted in the opening in the box for selective insertion into the box flush with the wall side of the box and extension therefrom. The housing has a pair of spaced slots formed therein for accommodating the prongs of an electrical connector plug. A plunger is affixed to the housing and extends through the opening through the wall side for movement in axial directions. The plunger has a head of electrically insulative material at an end in the box in proximity with the resilient end of the circuit members equidistantly spaced therefrom and therebetween. In the absence of an electrical connector plug in the receptacle, the housing extends from the box and the plunger is spaced from the resilient ends of the circuit members and the circuit members are maintained in open circuit relation although an electrically conductive object inserted into the box via either slot in the housing does not contact one of them. When an electrical connector plug is inserted in the housing, the housing is moved into the receptacle and the housing moves the plunger further into the box so that the head of the plunger abuts the resilient ends of the circuit members and moves the ends farther apart into electrical contact with the corresponding prongs of the electrical connector plug thereby closing the circuit of the circuit members via conductors connected to the prongs via the plug.

2 Claims, 5 Drawing Figures

SHOCKPROOF ELECTRICAL WALL RECEPTACLE

DESCRIPTION OF THE INVENTION

The present invention relates to a shockproof electrical wall receptacle. More particularly, the invention relates to a shockproof electrical wall receptacle having a box with a wall side having an opening formed therethrough for the prongs of an electrical connector plug and a back side having a pair of electrically conductive circuit members passing therethrough into the box in electrically insulative relation with the box and with each other.

Objects of the invention are to provide a shockproof electrical wall receptacle, which is of simple structure, inexpensive in manufacture, installable with facility and convenience in any standard electrical box, and functions efficiently, effectively and reliably to protect anyone inserting an electrically conductive object into either slot from electrical shock at all times.

In order that the invention may be readily carried into effect, it will now be described with reference to the accompanying drawing, wherein.

In the FIGS., the same components are identified by the same reference numerals.

Figure 1:
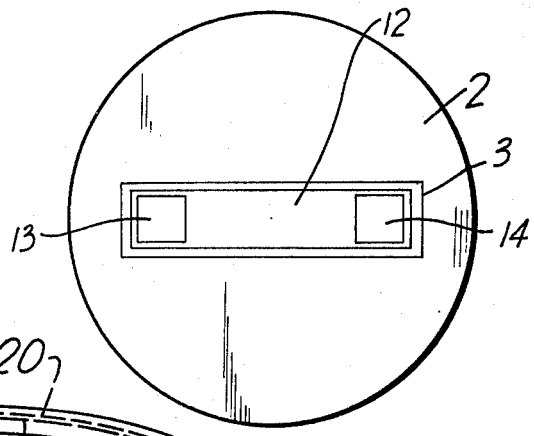
FIG. 1 is an axial view of an embodiment of the wall receptacle of the invention.
Figure 2:
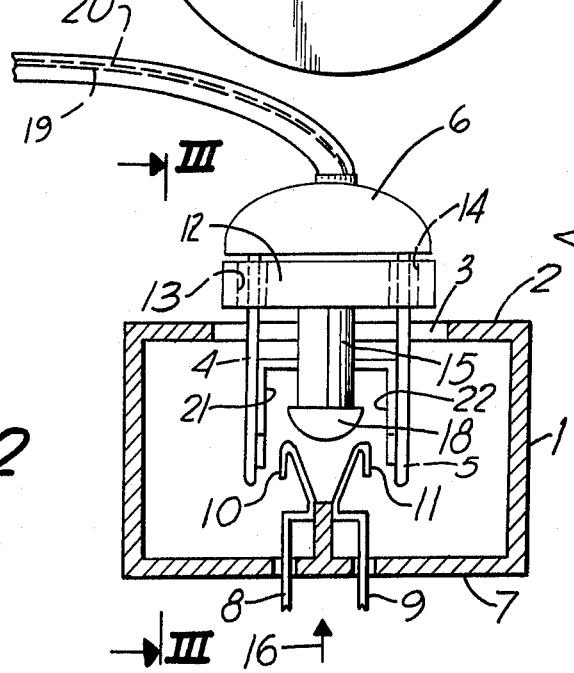
FIG. 2 is a cross-sectional view, partly in section, of the embodiment of FIG. 1 during initial insertion of an electrical connector plug thereinto.

The shockproof electrical wall receptacle of the invention has a box 1 (FIGS. 2 and 3) with a wall side 2 (FIGS. 1 to 3) having an opening 3 (FIGS. 1 and 2) formed therethrough for the prongs 4 and 5 (FIGS. 2 and 5) of an electrical connector plug 6 (FIG. 2). The box 1 has a back side 7 (FIGS. 2 and 3) having a pair of electrically conductive circuit members 8 and 9 (FIGS. 2 and 5) passing into the box. The circuit members 8 and 9 are in electrically insulative relation with the box 1 and with each other, since they are covered with electrical insulation.

The wall receptacle of the invention comprises resilient ends 10 and 11 (FIGS. 2 and 5) of electrically conductive material extending from the ends of the electrically conductive circuit members 8 and 9 in the box 1. The resilient ends 10 and 11, may comprise any suitable electrically conductive metal, such as, for example, copper, affixed to the free ends of the electrically conductive circuit members 8 and 9 in the box. The resilient ends 10 and 11 are positioned in spaced angular relation with each other in a generally V shape and are positioned between the prongs 4 and 5 of the electrical connector plug 6 (FIG. 2) inserted in the box. The resilient ends 10 and 11 are spaced from the prongs 4 and 5.

Figure 4:
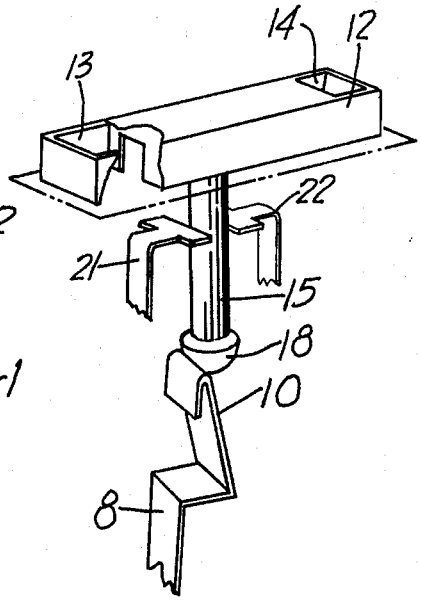
FIG. 4 is a perspective view of part of the embodiment of FIG. 1.
Figure 3:
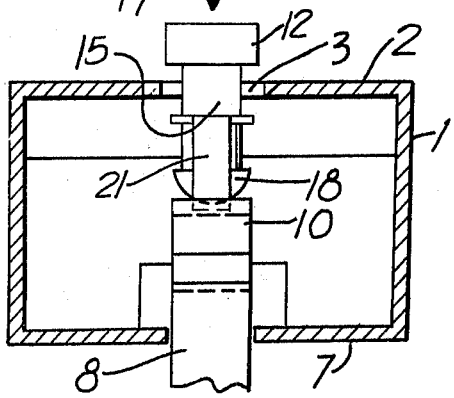
FIG. 3 is a cross-sectional view, partly in section, taken along the lines III—III, of FIG. 2.

A housing 12 (FIGS. 1 to 4) of substantially rectangular parallelepiped configuration is movably mounted in the opening 3 in the box 1. The housing 12 is selectively insertable into the box 1 flush with the wall side 2 of the box and is extendable from said wall side, as shown in FIGS. 2 and 3. The housing 12 has a pair of spaced slots 13 and 14 formed therein for accommodating the prongs 4 and 5 of the electrical connector plug 6 (FIGS. 1, 2 and 4).

A plunger 15 (FIGS. 2 to 5) is affixed to the housing 12 and extends through the opening 3 through the side wall for movement in axial directions indicated by arrows 16 and 17 of FIG. 3. The plunger 15 has a head 18 (FIGS. 2 to 5) of electrically insulative material of any suitable type such as, for example, Bakelite, rubber, or the like, at an end in the box 1 in proximity with the resilient ends 10 and 11 of the circuit members 8 and 9. The head 18 is equidistantly spaced from the resilient ends 10 and 11 and is positioned therebetween.

In the absence of an electrical connector plug in the receptacle, the housing 12 extending from the box and the plunger 15 is spaced from the resilient ends 10 and 11 of the circuit members 8 and 9 and the circuit members are maintained in open circuit relation although an electrically conductive object inserted into the box via either slot 13 or 14 does not contact one of them. Thus, anyone inserting such an object into the box will not be electrically shocked in any way.

Figure 5:
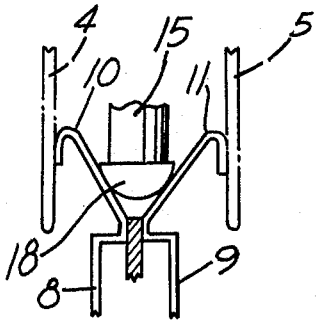
FIG. 5 is a view illustrating the disposition of the components of the wall receptacle of the invention when an electrical connector plug is fully inserted thereinto.

When an electrical connector plug 6 is inserted in the housing 12, said housing is moved into the receptacle and moves the plunger 15 further into the box, so that the head 18 of said plunger abuts the resilient ends 10 and 11 of the circuit members 8 and 9 and moves said ends farther apart into electrical contact with the corresponding prongs 4 and 5 of the electrical connector plug, as shown in FIG. 5, thereby closing the circuit of the circuit members via conductors 19 and 20 (FIG. 2) connected to the prongs via said plug.

A pair of electrically conductive lugs 21 and 22 (FIGS. 2 and 4) are provided. The lug 21 is interposed between the prong 4 of the plug 6 and the end 10 of the circuit member 8. The lug 22 is interposed between the prong 5 of the plug 6 and the end 11 of the circuit member 9. The lugs 21 and 22 thus provide electrical contact between the prongs 4 and 5 of the electrical connector plug 6 which abut them and the ends 10 and 11 of the circuit members 8 and 9.

The prongs 4 and 5 of the plug 6 are inserted in the slots 13 and 14 of the housing 12. At a certain point, the prongs 4 and 5 make electrical contact with the lugs 21 and 22, respectively. The lugs 21 and 22 function as pressure plates to hold the prongs of the plug firmly in the socket. As the prongs make contact with the lugs, they force the lugs toward the piston. The wider portions of the lugs move clear of the narrower slots of the housing 12, thus permitting the plunger 15 to move freely into the box 1. The lugs thus function as safety detents, preventing the piston from closing the circuit before the prongs are inserted.

The plunger 15 is positioned firmly against the ends of the circuit members. Upon insertion of the plug in its fully extended position in the box 1, the plunger 15 spreads the ends 10 and 11 of the circuit members 8 and 9 apart to make electrical contact with the prongs 4 and 5 of said plug. Upon removal of the plug, the spring tension of the ends 10 and 11 forces the plunger 15 in a direction 16 out of the box (FIG. 3), thus eliminating the need for a separate return spring.

While the invention has been described by means of a specific example and in a specific embodiment, I do not wish to be limited thereto, for obvious modifications will occur to those skilled in the art without departing from the spirit and scope of the invention.

I claim:

1. A shockproof electrical wall receptacle having a box with a wall side having an opening formed therethrough for the prongs of an electrical connector plug and a back side having a pair of electrically conductive circuit members passing therethrough into the box in electrically insulative relation with the box and with each other, said receptacle comprising resilient ends of electrically conductive material extending from the ends of the electrically conductive circuit members in the box in spaced angular relation with each other in a generally V shape and positioned between the prongs of an electrical connector plug inserted in the box and spaced therefrom;

a housing of substantially rectangular parallelepiped configuration movably mounted in the opening in the box for selective insertion into the box flush with the wall side of the box and extension therefrom, said housing having a pair of spaced slots formed therein for accommodating the prongs of an electrical connector plug; and a plunger affixed to the housing and extending through the opening through the wall side for movement in axial directions, said plunger having a head of electrically insulative material at an end in the box in proximity with the resilient ends of the circuit members equidistantly spaced therefrom and therebetween in a manner whereby in the absence of an electrical connector plug in the receptacle the housing extends from the box and the plunger is spaced from the resilient ends of the circuit members and the circuit members are maintained in open circuit relation although an electrically conductive object inserted into the box via either slot in the housing is free from contact with one of them and when an electrical connector plug is inserted in the housing, the housing is moved into the receptacle and said housing moves the plunger further into the box so that the head of the plunger abuts the resilient ends of the circuit members and moves said ends farther apart into electrical contact with the corresponding prongs of the electrical connector plug thereby closing the circuit of the circuit members via conductors connected to said prongs via said plug.

2. A shockproof electrical wall receptacle as claimed in claim 1, further comprising a pair of electrically conductive lugs each interposed between a corresponding one of the prongs of the electrical connector plug and a corresponding one of the circuit members for providing electrical contact between the prongs of the electrical connector plug which abut them and the circuit members.

* * * * *